US011766109B1

(12) United States Patent
Sheldon

(10) Patent No.: US 11,766,109 B1
(45) Date of Patent: Sep. 26, 2023

(54) PERSONAL HYGIENE KIT

(71) Applicant: Adam Sheldon, Clearwater, FL (US)

(72) Inventor: Adam Sheldon, Clearwater, FL (US)

( * ) Notice: Subject to any disclaimer, the term of this patent is extended or adjusted under 35 U.S.C. 154(b) by 0 days.

(21) Appl. No.: 17/861,781

(22) Filed: Jul. 11, 2022

(51) Int. Cl.
*B65D 85/10* (2006.01)
*A45D 34/02* (2006.01)
*A45C 11/00* (2006.01)

(52) U.S. Cl.
CPC ..... *A45D 34/02* (2013.01); *A45C 11/008* (2013.01); *A45C 2011/007* (2013.01)

(58) Field of Classification Search
CPC ..... A45D 34/02; A45D 2200/057; A45C 11/008; A45C 2011/007; A45C 13/02; A45C 3/00; A24F 15/18; A24F 23/04; A24F 15/12; A24F 19/0064
USPC ..... 206/38, 581, 86, 37.4, 87, 216, 236
See application file for complete search history.

(56) References Cited

U.S. PATENT DOCUMENTS 4,979,525 A 12/1990 Chiou
7,334,684 B1 * 2/2008 Fontanilla ..... A45C 13/02 190/110
7,617,828 B1 11/2009 Sinha
2009/0145789 A1 * 6/2009 Panosian ..... B25H 3/00 206/373

* cited by examiner

*Primary Examiner* — King M Chu
(74) *Attorney, Agent, or Firm* — SANCHELIMA & ASSOCIATES, P.A.; Christian Sanchelima; Jesus Sanchelima

(57) ABSTRACT

A personal hygiene kit including a first section assembly attached to a central portion and a third section assembly attached to the central portion thereof. The first section assembly includes a first section wherein can be inserted and kept any hygiene personal kit or any type of lighter with a striker. The central portion includes a central portion which is configured as a reservoir to insert liquid perfume or cologne to spray through the top portion by a head spray having a rear side configured as a slot compartment. The third section assembly includes a third portion which is configured to store any candy or pellet by the user and has a holder on the side to fasten an external personal item. The central portion with the first section and third section on the sides thereof are sealed on the top by a cap to prevent any debris.

11 Claims, 4 Drawing Sheets

PERSONAL HYGIENE KIT

BACKGROUND OF THE INVENTION

1. Field of the Invention

The present invention relates to a personal hygiene kit and, more particularly, a personal hygiene kit that includes different sections configured to store tweezers, a toothpick, permanent matches, a chewing gum or any other personal hygiene item and including a reservoir to insert perfume and spray it by a spray mechanism.

2. Description of the Related Art

Several designs for hygiene items have been designed in the past. None of them, however, include a personal hygiene kit that includes a central reservoir with spray mechanism for perfume with two lateral sections with compartments to store any personal hygiene item.

Applicant believes that a related reference corresponds to U.S. Pat. No. 4,979,525 issued for a sanitary kit which includes a toothbrush, nail clippers, a razor, and a container of cologne. Applicant believes that another related reference corresponds to U.S. Pat. No. 7,617,828 issued for toiletries travel kit. None of these references, however, teach of a personal hygiene travel kit that is comprised of a small rectangular container which holds a pair tweezers, a toothpick, permanent matches, a refillable reservoir with a spray mechanism for perfume or cologne as well as chewing gum and has an external loop for securing ChapStick to the container.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a pocket size device to store any hygiene kit.

It is another object of this invention to provide a spray for cologne which can be rechargeable several times.

It is still another object of the present invention to provide sectional storages to accomplish several tools in one device.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
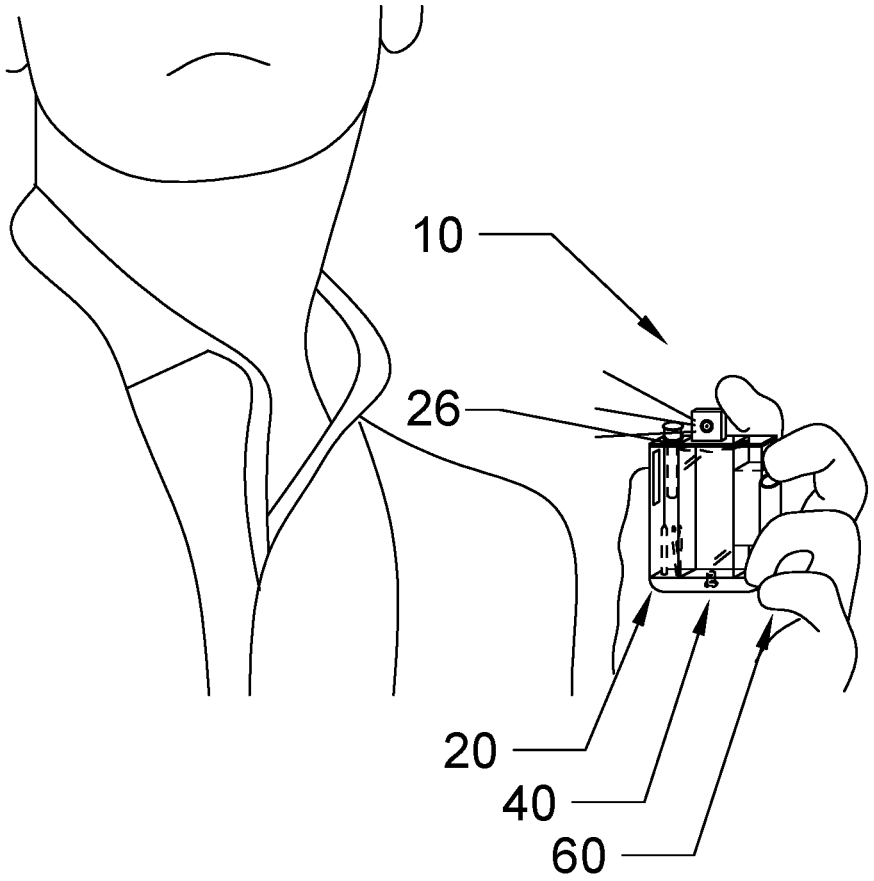
FIG. 1 represents an operational view of the present invention 10.
Figure 2:
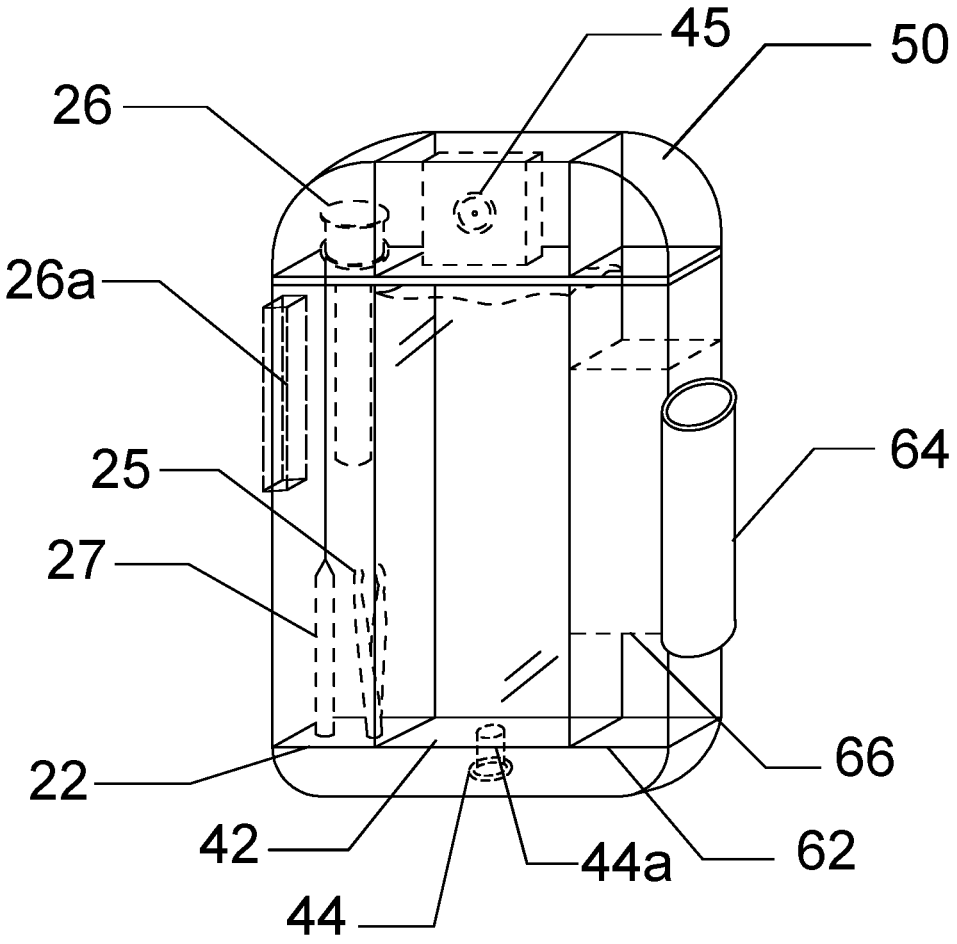
FIG. 2 shows an isometric view of a first section 22, a central portion 42 and a third section 62.

Referring now to the drawings, where the present invention is generally referred to with numeral 10, it can be observed that it basically includes a first section assembly 20, a central portion assembly 40 and a third section assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 4:
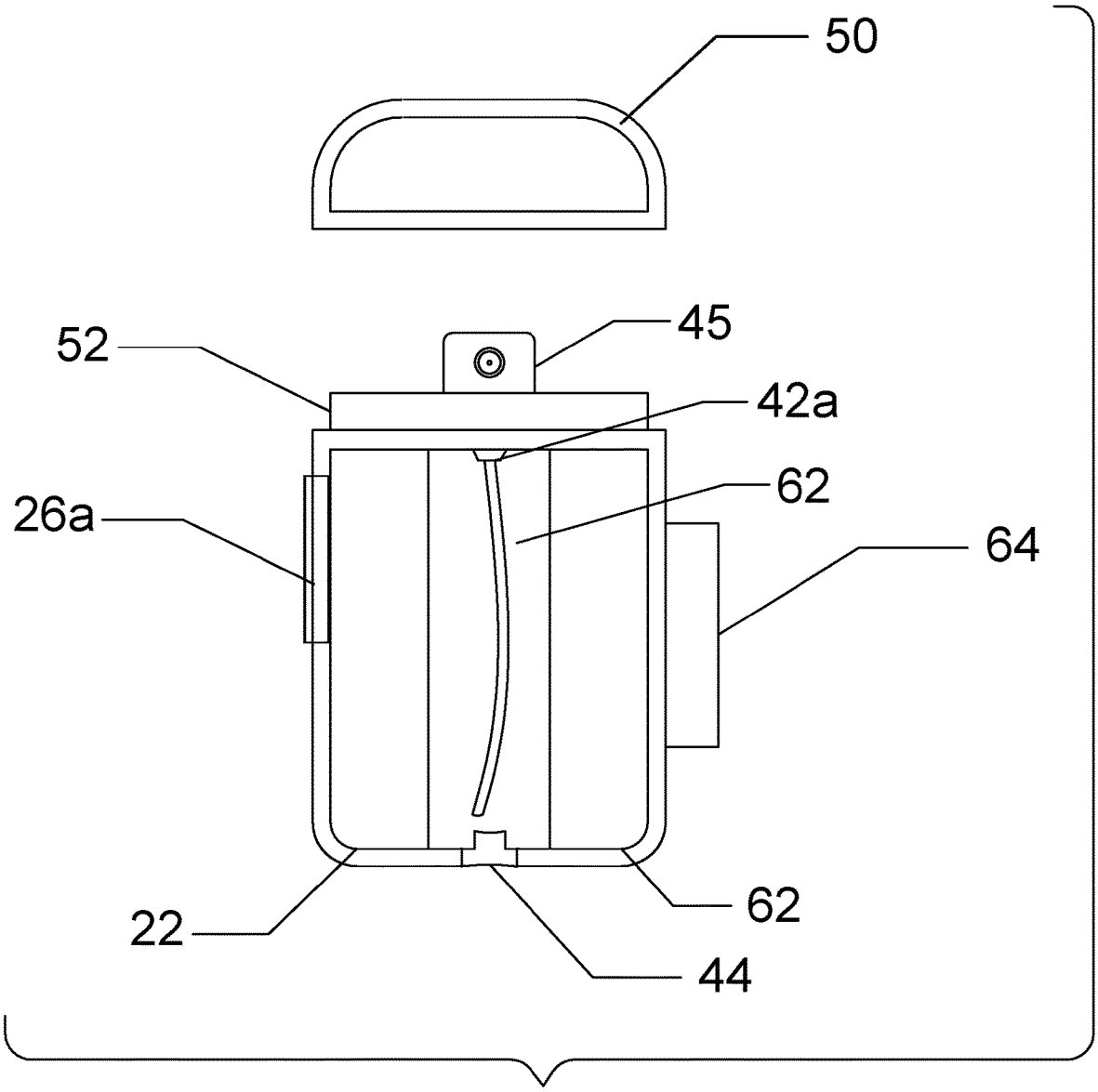
FIG. 4 is a representation of an internal view of the central portion 42 showing a fluid tube 42*a*.

The first section assembly 20 includes a first section 22, tweezers 25, a permanent match 26, a striker 26*a*, and a toothpick 27. The first section 22 may have a rectangular shape, a square shape, a circular shape in one embodiment. Nevertheless, as best observed in FIG. 4, first section 22 may have a rectangular hollow shape with a bottom rounded edge. The first section 22 may be configured to store the tweezers 25, a permanent match 26 and a toothpick 27 mainly. Nevertheless, in another embodiment the first section 22 may include any other personal hygiene product. It is to be considered that first section 22 may be made of a high-quality aluminum. Nevertheless, in other embodiments, a high-quality metal, or high-quality steel may be suitable for first section 22. In a preferred embodiment, first section 22 may be attached to a lateral side of the central portion assembly 40.

The tweezers 25, the permanent match 26, and the toothpick 27 may be made of a steel material, wood material, metal material, plastic material, or any other variation thereof. The tweezers 25 may be attached to the first section 22 in a bottom portion thereof. In one embodiment, the permanent match 26 may be attached to a top portion of the first section 22. In one embodiment, the toothpick 27 may be attached to a bottom portion of the first section 22 aside the tweezers 25. In other embodiments, the tweezers 25, the permanent match 26 and the toothpick 27 may be attached in a different configuration within the first section 22. It should be considered that the tweezers 25, the permanent match 26, and the toothpick 27 may have a shape that conforms with the room of the first section 22. It is to be considered that the permanent match 26 may be a type of permanent match. Nevertheless, it is to be considered that in another embodiment it may be suitable for the first section 22 to store a plastic spark wheel lighter, a piezo spark ignition lighter, a zippo-style lighter, a butane torch lighter, and electric coil lighter, and electric arc lighter or any other variation thereof may be suitable to be stored in the first section 22.

The striker 26*a* in a suitable embodiment may have a rectangular shape that conforms with a lateral side of the first section 22. The striker 26*a* may be configured to work with the permanent match 26 which is proximal within the first section 22. In one embodiment, the striker 26*a* may be made of a variation of materials like, sand, powdered glass and phosphorus which are suitable to light the permanent match 26 when required. In one embodiment the permanent match 26 may include the striker 26*a* in a lateral side of the first section 22. Nonetheless, the striker 26*a* may be placed in a top surface of the cap 50 as best observed in FIG. 3.

The central portion assembly 40 includes a central portion 42, a fluid tube 42*a*, an opening 44, a threaded cap 44*a*, a spray head 45, a cap 50, a protruding area 52, slot compartment 54, cash 54*a* and a pocket slot 55. In one embodiment, the central portion 42 may be attached to a side of the first section 22. As best observed in FIG. 4 central portion 42 may have a rectangular hollow body. Nevertheless, other shapes like, square, circular, trapezoidal, triangular, or any other variation may be suitable for central portion 42. In a suitable embodiment, the central portion 42 may be configured to be a reservoir to fill with perfume or any cologne. The central portion 42 may have attached a spray head 45 to a top surface and an opening 44 attached to a bottom surface of the central portion 42. In a suitable embodiment, the spray head 45 may have attached a fluid tube 42*a* to a bottom surface. When central portion 42 is filled by any liquid from cologne or perfume by the opening 44 and the sealed by the threated cap 44*a* the spray head 45 may be activated by pushing thereof and spray the perfume with the fluid tube 42*a*. It may be considered that the back portion of the As best observed in FIG. 4, the spray head 45 may have a square body. Nevertheless, other shapes like rectangular, semicircular, triangular, trapezoidal, or any other variation thereof may be suitable for spray head 45. The spray head 45 may be configured to spray the perfume with the fluid tube 42*a*. In a suitable embodiment, the fluid tube 42*a* may have an enlarged cylindrical body. In one embodiment, the fluid tube 42*a* may be made of a pliable plastic material. Nevertheless, in other embodiments, fluid tube 42*a* may be made of a metal material, rubber material, polymer material or any other variation thereof. It is to be considered that the opening 44 and the threaded cap 44*a* may have a shape that conforms with each other. When inserting the perfume through the opening 44 and filling the central portion 42, the threaded cap 44*a* may seal the opening 42. In a suitable embodiment, the threaded cap 44*a* may be made of a rubber material. Nevertheless, other materials like plastic, steel, wood, polymers or any other variation may be suitable for the threaded cap 44*a*. The opening 44 may be configured as an aperture for a reservoir which may be the central portion 42. The opening 44 may be suitable to be made of a material similar as the central portion 42 may be made of.

Figure 3:
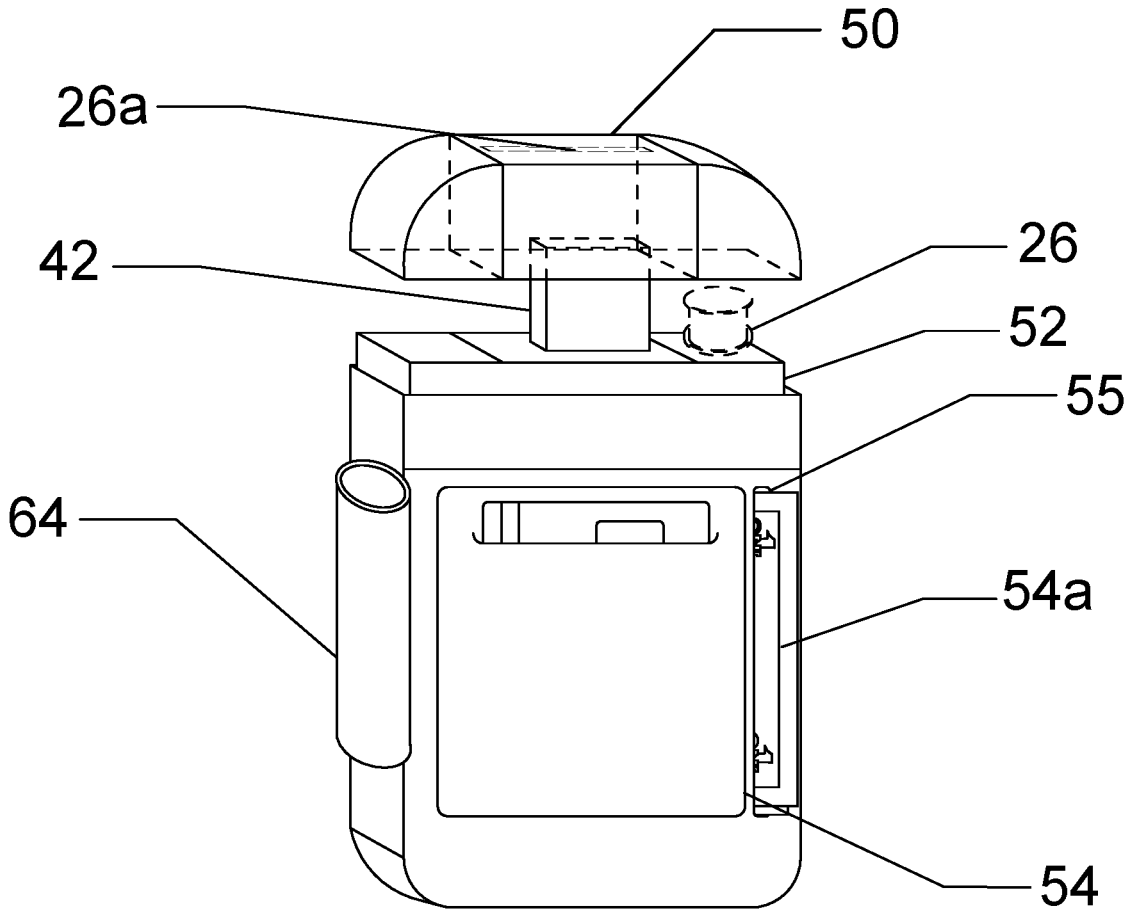
FIG. 3 illustrates a rear isometric view a slot compartment 54 and a pocket slot 55 with a top cap 50 at a top portion.

The cap 50 as best observed in FIG. 3 may have a rectangular hollow body with rounded edges. In a suitable embodiment the cap 50 may have a shape that conforms with the shape of the protruding area 52. Cap 50 may be suitable to seal the protruding area 50 allowing to seal the first section assembly 20, the central portion assembly 40 and the third section assembly 60. As a preferent embodiment, the cap 50 may be made of a high-quality aluminum. The cap 50 may be attached above the protruding area 52. In a suitable embodiment, the protruding area 52 may have a rectangular shape which extends outwardly from the top perimeter of the first section assembly 20, the central portion assembly 40 and the third section assembly 60. It is to be considered that protruding area 52 may be made of a high-quality aluminum as cap 50 may be made of. In a suitable embodiment, the protruding area 52 may be configured to allow the present invention 10 to be sealed. The slot compartment 54 in a suitable embodiment, may be made of a high-quality leather. Nevertheless, other materials, like, high-quality plastic, high-quality steel, high-quality metal or any other variation thereof may be suitable for the slot compartment 54. In a suitable embodiment the slot compartment 54 may be attached to a rear side of the central portion 42 as best observed in FIG. 3. The slot compartment 54 may be attached in a horizontal configuration as best observed in FIG. 3. It is to be considered that the slot compartment 54 may have a rectangular shape to store a card. In another embodiment, the central portion 42 may include a mirror attached to a rear side thereof. In one embodiment the pocket slot 55 may be a type of slot for cash as observed in FIG. 3. In another embodiment, the pocket slot 55 may be a type of elastic strap for cash. It is to be considered that the pocket slot 55 may be configured to insert and keep the cash 54*a* wherein cash 54*a* is configured to be inserted in a predetermined configuration including a folded configuration or any other variation thereof. The pocket slot 55 may be made of a high-quality leather as slot compartment 54 may be made of. In a suitable embodiment, the pocket slot 55 may have a shape that conforms with a folded dollar bill referring to the cash 54*a*. The pocket slot 55 may allow the rear side of the central portion assembly 40.

The third section assembly 60 includes a third section 62, a holder 64 and chewing gum 66. Third section 62 may have a rectangular shape with a rounded bottom corner as best observed in FIG. 4. The third section 62 may be made of a high-quality aluminum. Nevertheless, in another embodiment, the third section assembly 62 may be made of a high-quality metal, high quality carbon fiber, high quality steel, high-quality plastic, high quality polymer material, or any other variation thereof. The third section 62 may be configured to store any personal item like the chewing gum 66. It is to be considered that in other embodiment, any other type of candies may be suitable to store in the third section 62. In a suitable embodiment the third section 62 may be attached to a side of the central portion 42. The holder 64 may be suitable to have a cylindrical shape to conform with the shape of a ChapStick. The holder 64 in a suitable embodiment, may be made of a pliable material to allow inserting and fastening the ChapStick or any other item with an enlarged body. It may be considered that the back of the first section 22, central portion 42 and third section 62 are configured to have the slot compartment 54 wherein the pocket slot 55 is attached in a rear side of the slot compartment 54 to store multiple bills securely wherein the multiple bill van be folded and be inserted in a vertically configuration. It may be also considered that the present invention 10 may be configured to be stored y a pocket of a user's clothes. In another embodiment, the back of the first section 22, central portion 42 and third section 62 may be plain considering a predetermined size for the present invention 10 wherein it may be comprised of cologne/permute within the central portion 42, tweezers 27 and the toothpick 25.

In a preferred embodiment the front of the first section 22, central portion 42 and third section 62 may be configured to be laser engraved with any design customized for a gift, names, logos or any other variation thereof.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A personal hygiene kit, comprising:

a first section assembly including a first section with a rectangular hollow body with a bottom rounded corner; and a central portion assembly including a central portion with a rectangular hollow portion with an opening on the bottom thereof and a slot compartment to the rear side thereof, said slot compartment partially covering said central portion, wherein said central portion has a spray head attached to a top surface;

a third section assembly including a third section with a rectangular hollow body having a holder on the side thereof which has an enlarged cylindrical body.

2. The personal hygiene kit of claim 1, wherein said first section is configured to store any item related to hygiene such as a toothbrush or a gum.

3. The personal hygiene kit of claim 1, wherein said first section, central portion and third section are placed in abuting contact.

4. The personal hygiene kit of claim 1, wherein said opening is configured to insert liquid perfume or cologne.

5. The personal hygiene kit of claim 1, wherein said spray head has a fluid tube attached to a bottom thereof.

6. The personal hygiene kit of claim 1, wherein said opening is sealed by a threaded cap.

7. The personal hygiene kit of claim 1, wherein said spray head is sealed by a cap.

8. The personal hygiene kit of claim 1, wherein said cap is mounted to a protruding portion which extends outwardly from the top perimeter of said first section with central portion and third section.

9. The personal hygiene kit of claim 1, wherein said third section includes a holder attached to a side thereof.

10. The personal hygiene kit of claim 1, wherein said first section includes a striker in a lateral side thereof for a permanent match.

11. A personal hygiene kit, consisting of:

a first section assembly including a first section with a rectangular hollow body with a bottom rounded corner, said first section configured as a storing container to store any hygiene kit including tweezers, a permanent match and a toothpick, said first section configured to store any type of lighter including the permanent match or any other variation thereof, said first section includes a striker in a lateral side thereof for a permanent match;

a central portion assembly including a central portion with a rectangular hollow portion with an opening on the bottom thereof, said central portion configured as a reservoir for a liquid perfume or cologne, said central portion having an opening attached to a bottom portion thereof configured to insert liquid perfume or cologne, said opening is sealed by a threaded cap, said central portion having a spray head with a fluid tube attached to a bottom portion, wherein said cap seals said first section, central portion and third portion, said protruding portion extends outwardly the top perimeter of the first section, central portion and third portion, said central portion includes a slot compartment configured to attach any credit card and a rear pocket slot to insert folded cash; and third section assembly including a third section with a rectangular hollow body having a holder on the side thereof, said first section, said central portion and said third section placed in abuting contact, said third section having a holder which has a cylindrical hollow body to fasten a chapstick, said third section configured to store any other candy or personal item thereof like a chewing gum.

* * * * *